US007905738B2

(12) United States Patent
Donetsky

(10) Patent No.: US 7,905,738 B2
(45) Date of Patent: Mar. 15, 2011

(54) LAMP SOCKET

(76) Inventor: Yurij Donetsky, Balashikha (RU)

( * ) Notice: Subject to any disclaimer, the term of this patent is extended or adjusted under 35 U.S.C. 154(b) by 0 days.

(21) Appl. No.: 12/450,236

(22) PCT Filed: Jun. 6, 2008

(86) PCT No.: PCT/RU2008/000353

§ 371 (c)(1),
(2), (4) Date: Sep. 17, 2009

(87) PCT Pub. No.: WO2009/025579

PCT Pub. Date: Feb. 26, 2009

(65) Prior Publication Data

US 2010/0144211 A1 Jun. 10, 2010

(30) Foreign Application Priority Data

Aug. 17, 2007 (RU) ..... 2007131371

(51) Int. Cl.
*H01R 4/38* (2006.01)

(52) U.S. Cl. ..... 439/254; 439/266

(58) Field of Classification Search ..... 439/253–257, 439/265, 266, 339, 663, 702
See application file for complete search history.

(56) References Cited

U.S. PATENT DOCUMENTS

| | | | | |
|---|---|---|---|---|
| 5,380,214 | A * | 1/1995 | Ortega, Jr. | 439/253 |
| 6,932,491 | B2 | 8/2005 | Esakoff | |
| 7,270,561 | B2 * | 9/2007 | Chiu | 439/357 |
| 7,618,288 | B1 * | 11/2009 | DiFusco | 439/602 |

FOREIGN PATENT DOCUMENTS

| | | |
|---|---|---|
| RU | 2296402 | 3/2007 |
| SU | 885697 | 11/1981 |

* cited by examiner

*Primary Examiner* — Khiem Nguyen
(74) *Attorney, Agent, or Firm* — Aleksandr Smushkovich

(57) ABSTRACT

A lamp socket is disclosed for connecting an electric bulb, having a base, base contact, and bottom contact, to an electrical grid. The socket comprises (a) a clamp including a spring-loaded embracing section with a first contact, capable of passing the base through in an open position and gripping it in a closed position, and a spring-loaded dielectric retainer, having a second contact, capable of retaining the section in the open position and releasing it into the closed position upon being depressed by the base, and (b) a spring-loaded clasp, capable of expanding the section in to the open position. While the clamp is being in the closed postion, the first contact is depressed by the base contact, and the second contact is depressed by the bottom contact. The section and retainer can be made as a single whole, and spring-loaded by one spring. The socket increases safety of operation.

2 Claims, 4 Drawing Sheets

LAMP SOCKET

CROSS-REFERENCES TO RELATED APPLICATIONS

This application is a U.S. national phase application of a PCT application PCT/RU2008/000353 filed on 6 Jun. 2008, published as WO2009025579, whose disclosure is incorporated herein in its entirety by reference, which PCT application claims priority of a Russian Federation patent application RU2007131371 filed on 17 Aug. 2007.

FIELD OF THE INVENTION

This invention belongs to the field of electrical engineering. It can be used in electrical lighting devices to connect electric bulbs.

BACKGROUND OF THE INVENTION

A conventional lamp socket typically consists of a case, an electric bulb cap, and spring-loaded electric contacts. The electric bulb cap is a cylindrical sleeve. The sleeve has a helical groove or a bayonet retainer. The electric bulb is installed into the lamp socket with a helical groove or a bayonet retainer with an application of effort. The effort ensures the spring-loaded contacts of the lamp socket press against the electric bulb contacts. It also takes an effort to remove a faulty (burned-out) electric bulb. Due to the widespread use of lighting devices, the labor-intensive process of installing and replacing electric bulbs causes substantial financial losses. It is especially difficult to remove an electric bulb with a broken bulb glass, since it is difficult to apply the required force without holding the bulb. A risk of injury is involved. The reliability of electrical contact is ensured by the elastic properties of the conductor. In case of non-elastic deformation of contacts due to mechanical or thermal impacts, the risk of a lighting device malfunction increases. This is a frequent occurrence during the operation of lighting devices. Sometimes an electric bulb is installed with the power connected to make sure the lighting device is functional. This raises the risk of electrocution.

Prior art discloses a lamp socket (Patent RU 2 296 402 C1) that has been chosen as a prototype (the closest related art device) for this invention. It consists of a case, electrical contacts within the case, and an electric bulb cap. The electric bulb cap is made in the form of a clamp with a spring, an arm, a retainer, and a retainer release button. The clamp consists of a movable part and an immovable part. When an electric bulb is places into the lamp socket, the electric bulb base freely enters the retainer. The bottom contact of the electric bulb depresses the contact of the lamp socket and shifts the retainer release button. The retainer releases the arm. Under the influence of the spring, the arm presses the movable part of the clamp together with the retainer contact tip to the electric bulb base, clamping the base. The retainer contact is pressed against the electric bulb contact by means of the retainer release button. The retainer contact is pressed against the electric bulb base by means of the spring via the arm and the movable part of the clamp. To extract the electric bulb, one has to press the end of the arm in the direction of the glass bulb. When this is done, the arm compresses the spring, shifts the movable part of the electric bulb base clamp, and releases the electric bulb base from the retainer. This lamp socket design enables easy installation and replacement of electric bulbs while ensuring reliable contact with the electric bulb. Yet, the design described here is rather complex compared to a standard lamp socket. The arm releasing the electric bulb base from the clamp is located close to the electric bulb, so there is a risk of sustaining burns if the electric bulb is still hot.

BRIEF DESCRIPTION OF THE INVENTION

The present invention provides a combination of the following technological effects: simplified design and reduced risk of injury when replacing even a hot electric bulb.

The technological result is achieved by making the lamp socket for an electric bulb in the form of a clamp including an open position retainer having an electrical contact. The clamp is a single element. It is made of a predetermined dielectric elastic material or spring-loaded dielectric material and has a shape that allows tightly gripping the electric bulb's base contact, and depressing the retainer's contacts against the electric bulb base's contact. The clamp includes an embracing section, and a clasp, capable of opening the clamp and associated with the clamp, which opening clasp is designed to expand the embracing section of the clamp to a size that allows the electric bulb base freely entering the clamp. The open position retainer retains the embracing section of the clamp in a position that allows the electric bulb base freely entering the clamp and, when the electric bulb's contact presses upon the retainer's contact, the retainer releases the embracing section to enable griping the electric bulb base tightly. When the clamp retains the electric bulb in the working position, the retainer depresses the retainer's contact against the electric bulb's bottom contact.

DETAIL DESCRIPTION OF A PREFERRED EMBODIMENT OF THE INVENTION

Figure 1:
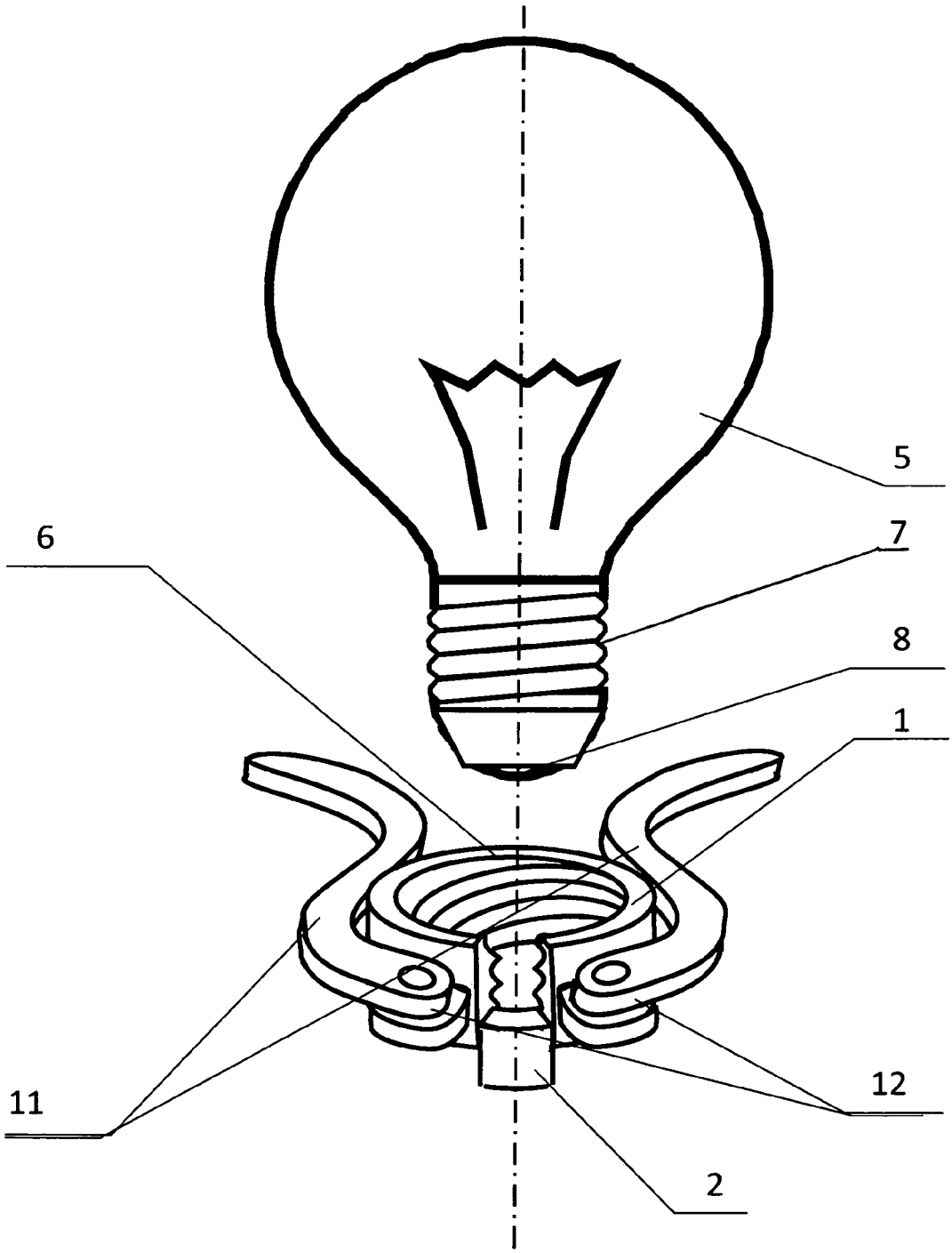
FIG. 1 shows the inventive lamp socket ready for installation of the electric bulb.
Figure 2:
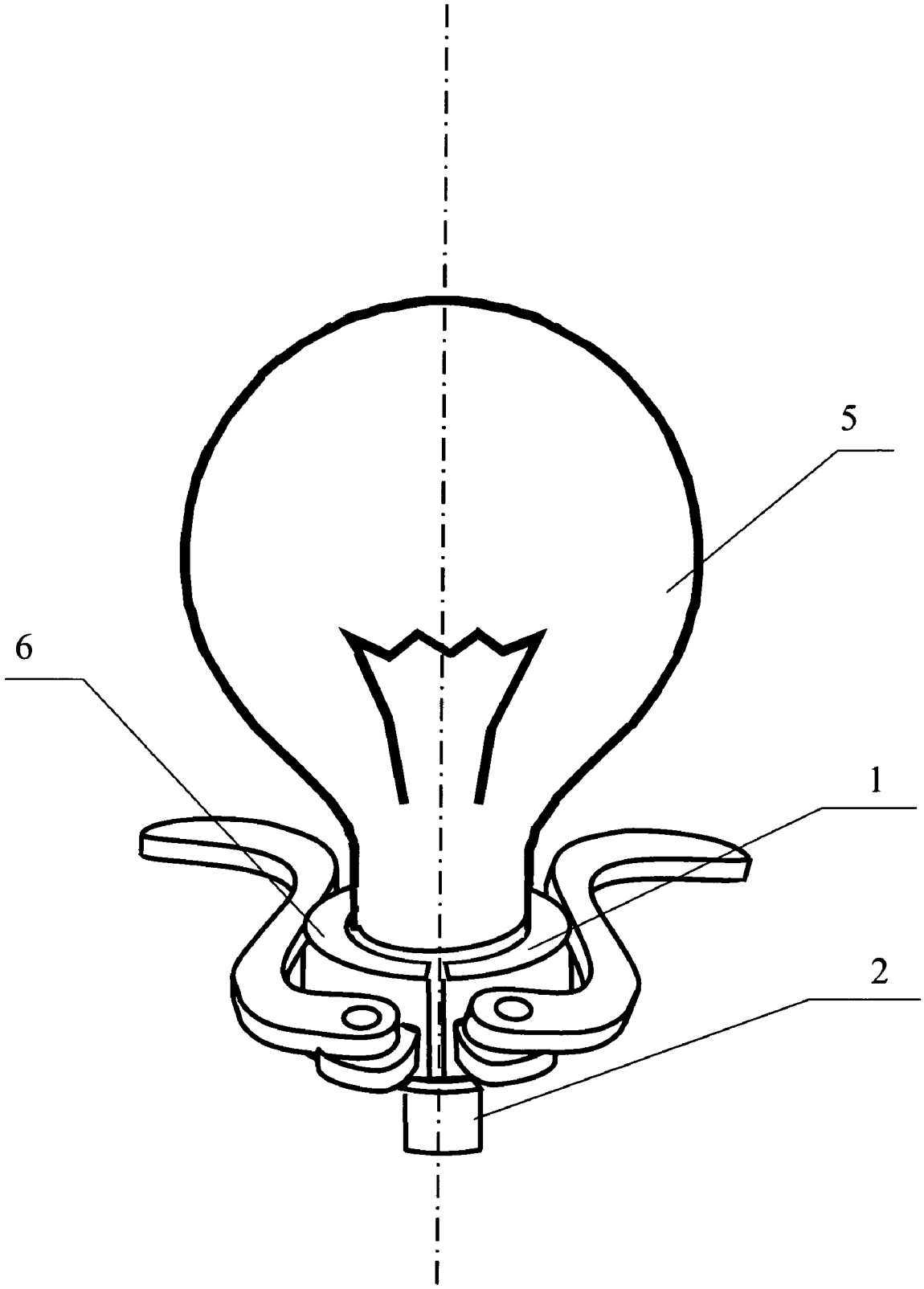
FIG. 2 shows the inventive lamp socket with an installed electric bulb.

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

Figure 3:
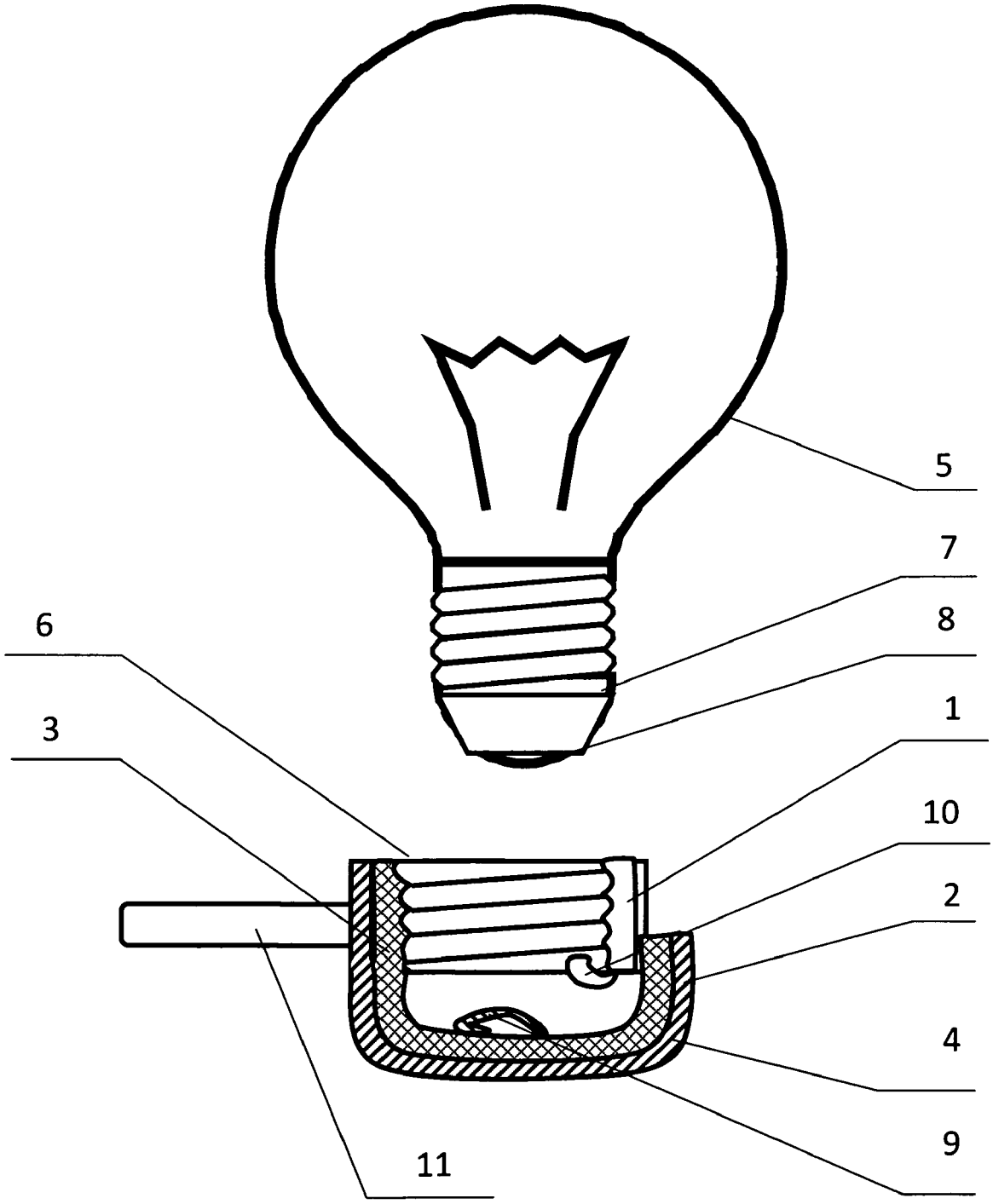
FIG. 3 shows a side view of the inventive lamp socket ready for installation of the electric bulb.
Figure 4:
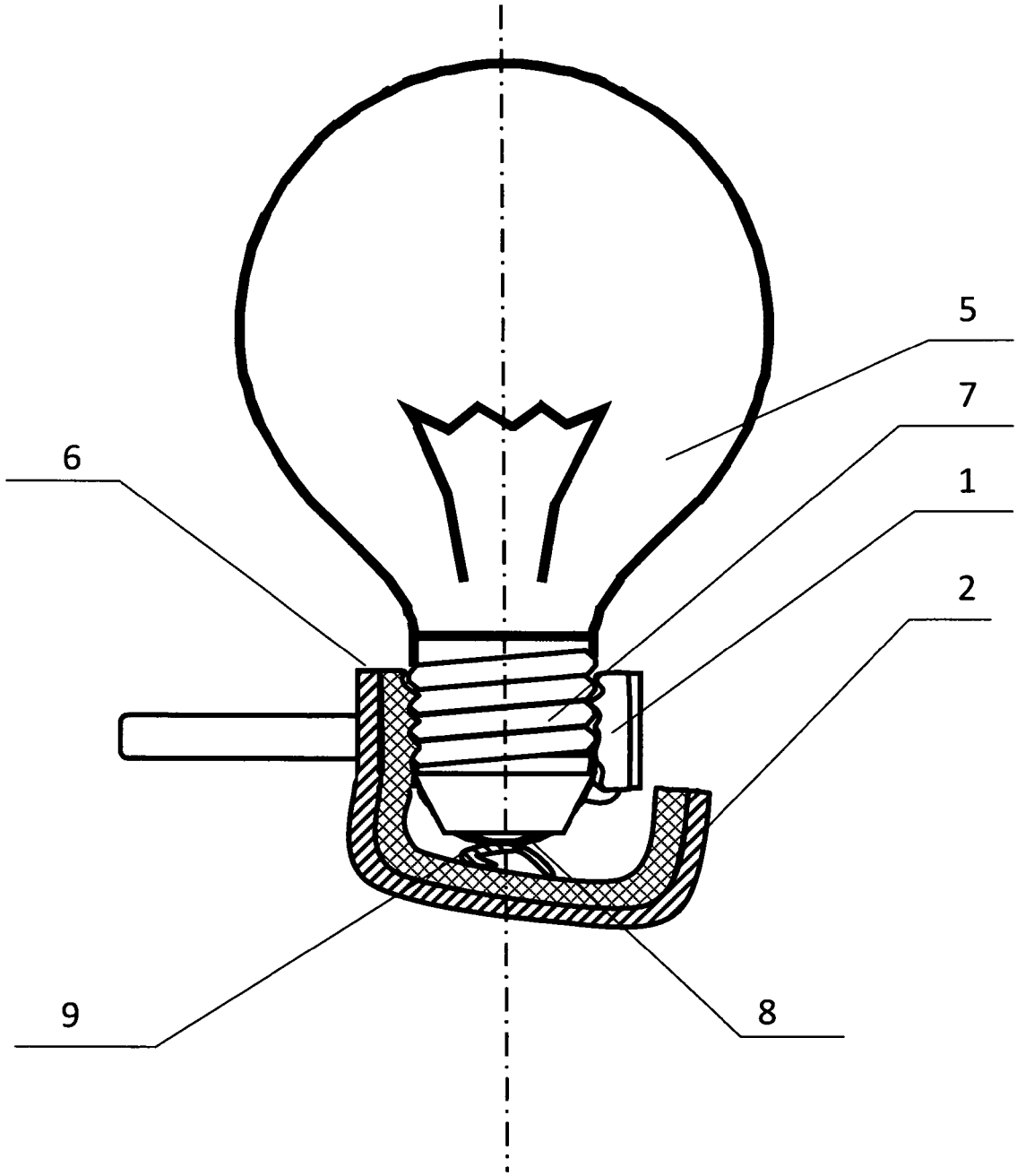
FIG. 4 shows a side view of the inventive lamp socket with an installed electric bulb.

A preferred embodiment of the inventive lamp socket (6) (illustrated on FIGS. 1-4) comprises: a clamp (shown on FIG. 1), including an embracing section (1) and a retainer (2), which retainer constitutes a single whole with the embracing section (1) and made of a dielectric material (3) loaded with a reinforcing spring (4) (shown on FIG. 3). The lamp socket (6) comprises a contact (9) located on the retainer (2), and a contact (10) (FIG. 3) located on the embracing section (1). The lamp socket (6) comprises a clamp opening clasp (12), including arms (11) (shown on FIG. 1). The clasp (12) is made in the shape of a clothes peg mounted on the clamp, and is spring-loaded. In the preferred embodiment, the retainer spring and the clasp spring are made as a single whole, i.e. the spring (4).

The embracing section (1) is capable of gripping an electric bulb (5) (FIGS. 1, 3). The bulb (5) includes a conductive base (7) (or 'base contact') and a bottom contact (8) isolated from the base (7). The embracing section (1) is retained in an open position that allows free passage of the electric bulb base (7) through the retainer (2).

When the electric bulb (5) is inserted into the lamp socket (6) (FIGS. 2, 4), the electric bulb base (7) freely enters the passage for the electric bulb base, and the bottom contact (8) (FIG. 4) of the electric bulb depresses against the contact (9) of the lamp socket. The retainer (2), depressed by the contact (9), releases the embracing section (1), which causes the embracing section (1) to contract and take a closed position. Thereafter, the electric bulb base (7) is tightly gripped by the retainer (2). The contact (10) is depressed against the electric bulb base (7) thanks to the elastic force of the clamp reinforcing spring, while the contact (9) of the lamp socket is depressed against the bottom contact (8) of the electric bulb thanks to the elastic force of the retainer reinforcing spring.

To extract the electric bulb (5) from the lamp socket (6), one has to press the tips of the arms (11) (FIGS. 2, 4) of the clamp opening clasp (12). At the same time, the embracing section (1) of the clamp will release the base (7) of the electric bulb, while the contact (10) (FIG. 3) of the lamp socket will return to its initial position (not touching the electric bulb's base).

The retainer (2) will start ejecting the electric bulb (5) from the lamp socket (6), and when the distance between the free ends of the embracing section (1) exceeds the width of the retainer (2), the clamp will return to its initial position. When the force is no longer applied to the arms (11) of the clamp opening clasp (12), the tips of the embracing section (1) will depress against the retainer (2), which will create the space required for free passage of the electric bulb base (7).

Therefore, the proposed lamp socket has a simple technological design. It allows installing the electric bulb easily by inserting the electric bulb base into the retainer until the retainer is triggered. In this case both contacts of the lamp socket will be reliably pressed with an adjustable force to the electric bulb contacts by the elastic elements located outside the area where they can be influenced by the temperature and current of the operating electric bulb. It is equally easy and safe to extract a faulty electric bulb from the retainer after pressing the arms of the clamp opening clasp until the retainer is triggered, even if the bulb glass is still hot.

The invention claimed is:

1. A lamp socket for connecting an electric bulb to an electrical grid, said bulb having a base with a base contact and a bottom contact located at the bottom of said base and isolated therefrom, said lamp socket comprises:

(a) a clamp including a spring-loaded embracing section, capable of passing said base through in an open position, and of gripping said base in a closed position, said embracing section has a first contact thereon; and a spring-loaded dielectric retainer capable of retaining said embracing section in the open position and releasing said embracing section into the closed position upon being depressed by said base, said retainer has a second contact thereon; and (b) a spring-loaded clasp, associated with said clamp, and capable of expanding said embracing section in to the open position;

wherein, while said clamp being in the closed postion, said first contact is predeterminedly depressed by said base contact, and said second contact is predeterminedly depressed by said bottom contact.

2. The lamp socket according claim 1, wherein said embracing section and said retainer are made as a single whole.

* * * * *